US011002227B2

(12) United States Patent
Zhong et al.

(10) Patent No.: US 11,002,227 B2
(45) Date of Patent: May 11, 2021

(54) ENGINE AND MIXED-GAS INTAKE DEVICE THEREOF

(71) Applicant: WEICHAI POWER CO., LTD., Shandong (CN)

(72) Inventors: Yuelan Zhong, Shandong (CN); Ziyang Dai, Shandong (CN)

(73) Assignee: WEICHAI POWER CO., LTD., Shandong (CN)

( * ) Notice: Subject to any disclaimer, the term of this patent is extended or adjusted under 35 U.S.C. 154(b) by 0 days.

(21) Appl. No.: 16/650,955

(22) PCT Filed: Dec. 27, 2017

(86) PCT No.: PCT/CN2017/118996

§ 371 (c)(1),
(2) Date: Mar. 26, 2020

(87) PCT Pub. No.: WO2019/127098

PCT Pub. Date: Jul. 4, 2019

(65) Prior Publication Data

US 2020/0408173 A1 Dec. 31, 2020

(51) Int. Cl.
*F02M 26/21* (2016.01)
*F02M 26/70* (2016.01)
(Continued)

(52) U.S. Cl.
CPC ..... *F02M 26/21* (2016.02); *F02M 26/70* (2016.02); *F02M 26/19* (2016.02); *F02M 26/64* (2016.02)

(58) Field of Classification Search
CPC ..... F02M 26/21; F02M 26/70; F02M 26/64; F02M 26/19
See application file for complete search history.

(56) References Cited

U.S. PATENT DOCUMENTS

2013/0167812 A1* 7/2013 Kurihara ..... F02M 26/16 123/568.11
2015/0027420 A1* 1/2015 Antoni ..... F02M 26/66 123/568.21

(Continued)

FOREIGN PATENT DOCUMENTS

CN 102230429 A 11/2011
CN 106884746 A 6/2017
CN 108104986 A 6/2018

(Continued)

OTHER PUBLICATIONS

International Search Report for corresponding PCT/CN2017/118996; dated Oct. 8, 2018.

(Continued)

*Primary Examiner* — Xiao En Mo
(74) *Attorney, Agent, or Firm* — Cantor Colburn LLP

(57) ABSTRACT

A mixed-gas intake device of an engine comprises an air intake duct. A side wall of the air intake duct is provided with an exhaust inlet. The mixed-gas intake device is characterized in that the same also comprises blades disposed in the air intake duct and a flow control device used for adjusting the distance between two adjacent blades. The blades are arranged at an exhaust inlet end. The multiple blades are arranged in a ring. An exhaust intake space is formed between the side wall of the air intake duct and the blades. The mixed-gas intake device uses the flow control device to adjust the distance between two adjacent blades, so as to adjust the amount of input exhaust, thereby eliminating the need to install a dedicated valve. The multiple blades are arranged in a ring, such that exhaust is evenly mixed with air after entering the air intake duct, thereby eliminating the need to install a dedicated mixer, and effectively reducing the overall volume of the mixed-gas intake device. Further (Continued)

disclosed is an engine comprising the mixed-gas intake device.

20 Claims, 12 Drawing Sheets

(51) Int. Cl.
*F02M 26/64* (2016.01)
*F02M 26/19* (2016.01)

(56) References Cited

U.S. PATENT DOCUMENTS

| | | | | |
|---|---|---|---|---|
| 2016/0097351 | A1* | 4/2016 | Kiener | F02M 26/19<br>123/568.18 |
| 2016/0281651 | A1* | 9/2016 | Hashimoto | F02M 26/21 |

FOREIGN PATENT DOCUMENTS

| | | | |
|---|---|---|---|
| CN | 207761833 | U | 8/2018 |
| DE | 202016103188 | U1 | 6/2016 |
| EP | 1152141 | A1 | 7/2001 |
| JP | 2013087720 | A | 5/2013 |
| WO | 2017034548 | A1 | 3/2017 |

OTHER PUBLICATIONS

EPO Extended European Search Report for corresponding EP Application No. 17936441.9 ; dated Nov. 13, 2020.
IPIN Office Action for corresponding IN Application No. 202017010472; dated Oct. 15, 2020.

* cited by examiner

ENGINE AND MIXED-GAS INTAKE DEVICE THEREOF

CROSS-REFERENCE TO RELATED APPLICATIONS

This is the U.S. national stage of application No. PCT/CN2017/118996, filed Dec. 27, 2017, titled "ENGINE AND MIXED-GAS INTAKE DEVICE THEREOF", the disclosure of which is incorporated herein by reference in its entirety.

FIELD

The present disclosure relates to the technical field of exhaust gas circulating utilization, and in particular to a hybrid gas intake device of an engine, and an engine including the hybrid gas intake device.

BACKGROUND

In recent years, destruction of the global ecological environment and greenhouse effect caused by automobile exhaust pollution and $CO_2$ emission become increasingly serious. A car with low exhaust pollution and low fuel consumption can mitigate global warming and the destruction of ecological balance caused by the global greenhouse effect. In order to reduce environmental pollution, with EGR (Exhaust Gas Recirculation) technology, exhaust gas discharged by the engine is reintroduced into a gas intake pipe and is mixed with fresh gas, and then the mixed gas flows into a combustion chamber for combustion. In this way, NOx emission of the engine can be effectively reduced.

In order to utilize the exhaust gas, a gas inlet of a conventional engine is provided with a hybrid gas intake device. Specifically, a conventional hybrid gas intake device includes a gas intake pipe and an exhaust gas intake pipe connected to a side wall of the gas intake pipe. The exhaust gas intake pipe is provided with an EGR valve that is a butterfly valve or a poppet valve. That is, the EGR valve that is the butterfly valve or the poppet valve is mounted independently in an EGR loop, to control an EGR flow. The gas intake pipe is provided with a mixer for mixing air and the exhaust gas.

However, the exhaust gas intake pipe is required to be provided with a valve body to control intake flow of the exhaust gas, and is also required to be provided with a mixer to mix the air and the exhaust gas, which results in a large overall volume of the hybrid gas intake device.

Therefore, how to reduce the overall volume of the hybrid gas intake device is a technical problem desired to be solved by those skilled in the art.

SUMMARY

An object of the present disclosure is to provide a hybrid gas intake device of an engine, which has a small overall volume. Another object of the present disclosure is to provide an engine including the hybrid gas intake device.

In order to achieve the above objects, a hybrid gas intake device of an engine is provided according to the present disclosure. The hybrid gas intake device includes a gas intake pipe. A side wall of the gas intake pipe is provided with an exhaust gas inlet. The hybrid gas intake device further includes a blade arranged in the gas intake pipe and a flow control device configured to adjust an interval between two adjacent blades. The blade is arranged at an end of the exhaust gas inlet, a number of the blade is more than one, and the more than one blade is distributed along a ring. Exhaust gas intake space is formed between the blade and the side wall of the gas intake pipe.

Preferably, the more than one blade is arranged along a circle, a centerline of the circle coincides with an axis of the gas intake pipe, and an interval between each two adjacent blades of the more than one blade is the same.

Preferably, the flow control device includes a connection element, a fixed plate, a rotatable plate, and a driving device configured to drive the rotatable plate to rotate. The fixed plate is fixed relative to the gas intake pipe. The blade is connected to the fixed plate by a first hinge pin. The first hinge pin is in clearance fit with the fixed plate. The rotatable plate is fixedly connected to a second hinge pin that is in one-to-one correspondence with the first hinge pin. The second hinge pin is rotatably connected to the connection element. The connection element is fixedly connected to the first hinge pin. The first hinge pin is in one-to-one correspondence with the blade.

Preferably, the flow control device includes two fixed plates and two rotatable plates. The rotatable plates are in one-to-one correspondence with the fixed plates. The two fixed plates are arranged at two opposite ends of the blade respectively.

Preferably, the gas intake pipe includes an air intake section, a blade mounting section, and a gas outlet section that are sequentially arranged along a gas moving direction. The blade and the flow control device are located in the blade mounting section. An inner diameter of the fixed plate is equal to an inner diameter of the air intake section. The inner diameter of the air intake section is equal to an inner diameter of the gas outlet section. The rotatable plate is sleeved outside the fixed plate. An outer wall of the rotatable plate is in clearance fit with a side wall of the blade mounting section.

Preferably, the blade mounting section is integrally formed with the gas outlet section, and the blade mounting section is detachably connected to the air intake section.

Preferably, the blade has a fusiform cross section in a direction perpendicular to an axis of the gas intake pipe.

Preferably, the blade is integrally formed.

Preferably, an anticorrosive layer is provided on a surface of the blade.

An engine is provided, which includes an engine body and a hybrid gas intake device connected to a gas inlet of the engine body, where the hybrid gas intake device of the engine is the above described hybrid gas intake device.

In the above technical solutions, the hybrid gas intake device according to the present disclosure includes a gas intake pipe, a blade arranged in the gas intake pipe and a flow control device configured to adjust an interval between two adjacent blades. A side wall of the gas intake pipe is provided with an exhaust gas inlet. The blade is arranged at an end of the exhaust gas inlet, a number of the blade is more than one, the more than one blade is distributed along a ring, and exhaust gas intake space is formed between the blade and the side wall of the gas intake pipe. In practical operation of the engine, the interval between two adjacent blades is adjusted by the flow control device, to control the intake flow of the exhaust gas. The exhaust gas flows into the gas intake pipe through the interval between two adjacent blades and is mixed with the air. Finally, the mixed gas flows into the engine body through the gas intake pipe.

It can be seen from the above description that in the hybrid gas intake device according to the present disclosure, the interval between two adjacent blades is adjusted by the flow control device so as to adjust the intake flow of the exhaust air, eliminating the need to install a dedicated valve. Since the multiple blades are distributed along a ring, the exhaust gas and the air can be well-mixed after the exhaust gas flows into the gas intake pipe, eliminating the need to install a dedicated mixer. Therefore, the overall volume of the hybrid gas intake device can be effectively reduced.

DETAILED DESCRIPTION OF EMBODIMENTS

Figure 1:
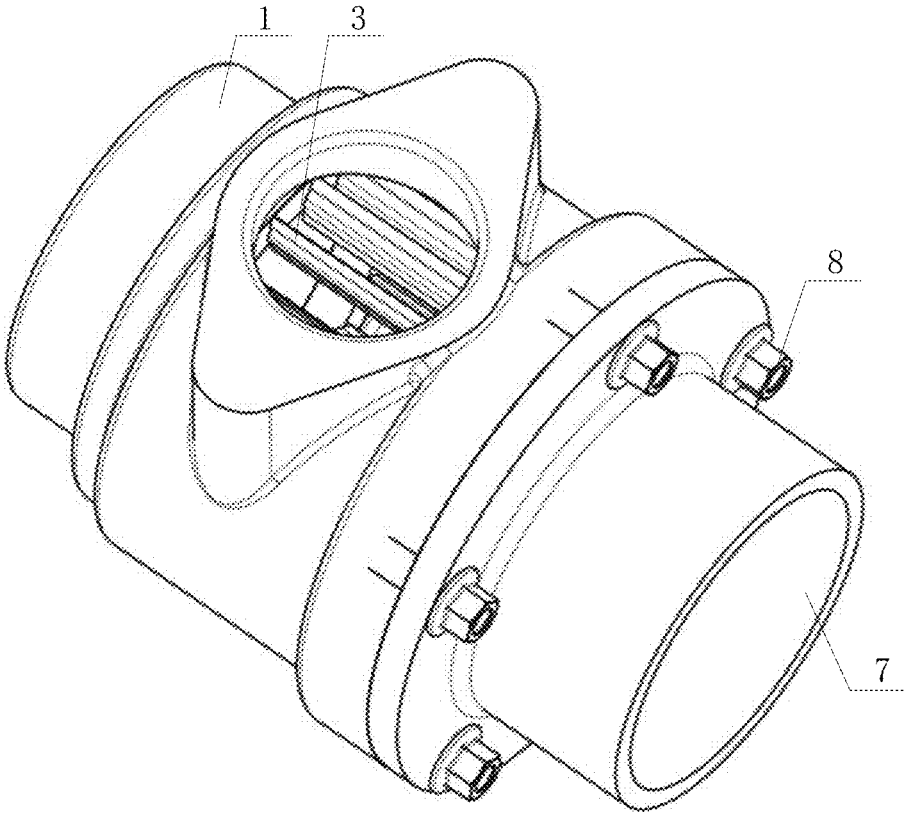
FIG. 1 is a three-dimensional structural diagram of a hybrid gas intake device in a case that blades are opened according to an embodiment of the present disclosure.
Figure 2:
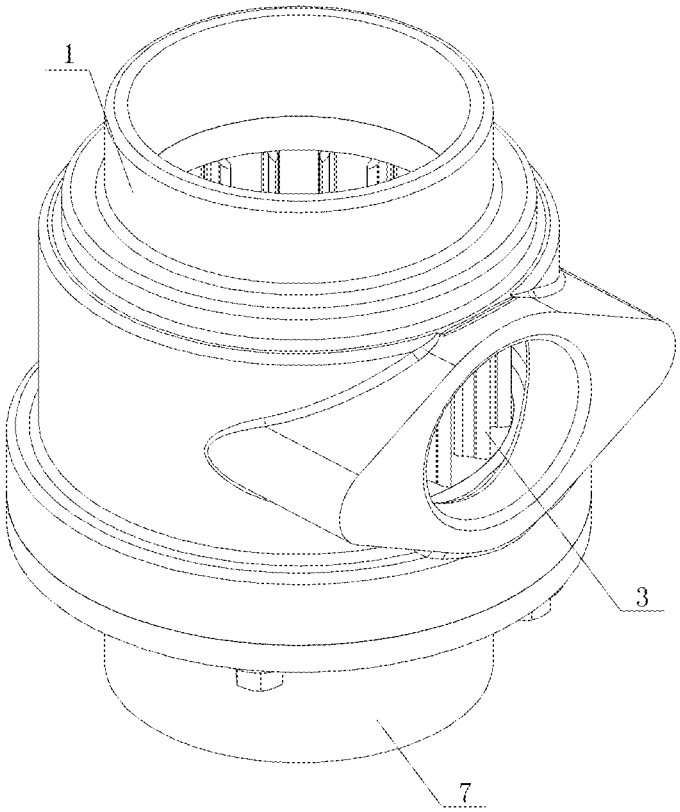
FIG. 2 is a three-dimensional structural diagram of the hybrid gas intake device from another perspective in the case that blades are opened according to an embodiment of the present disclosure.
Figure 3:
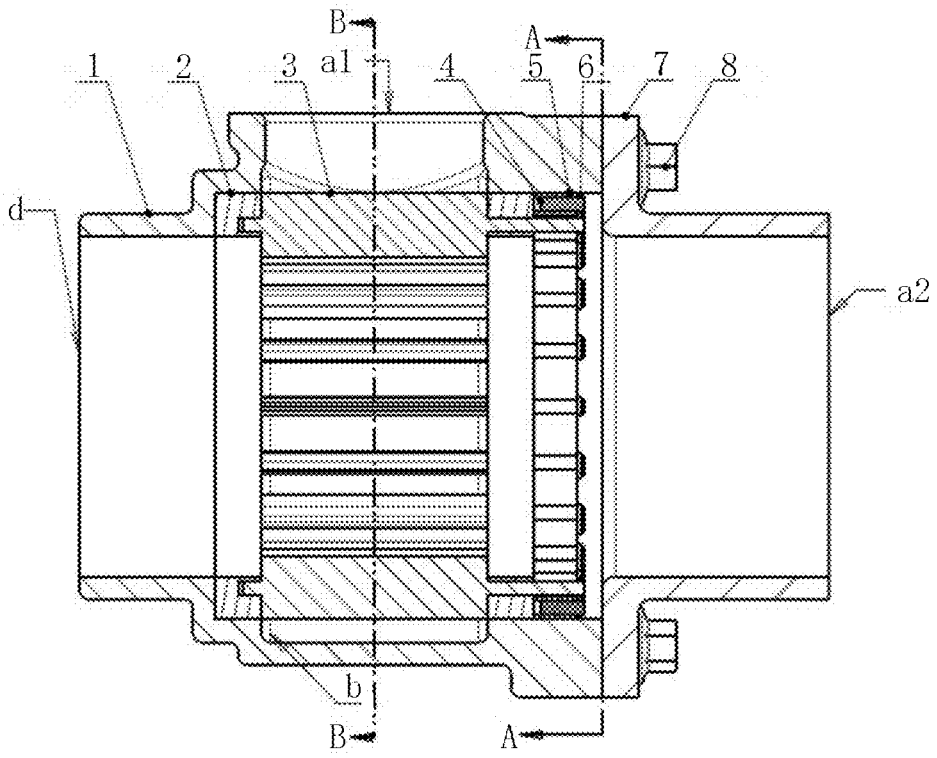
FIG. 3 is a schematic structural diagram of the hybrid gas intake device in the case that blades are opened according to an embodiment of the present disclosure.
Figure 4:
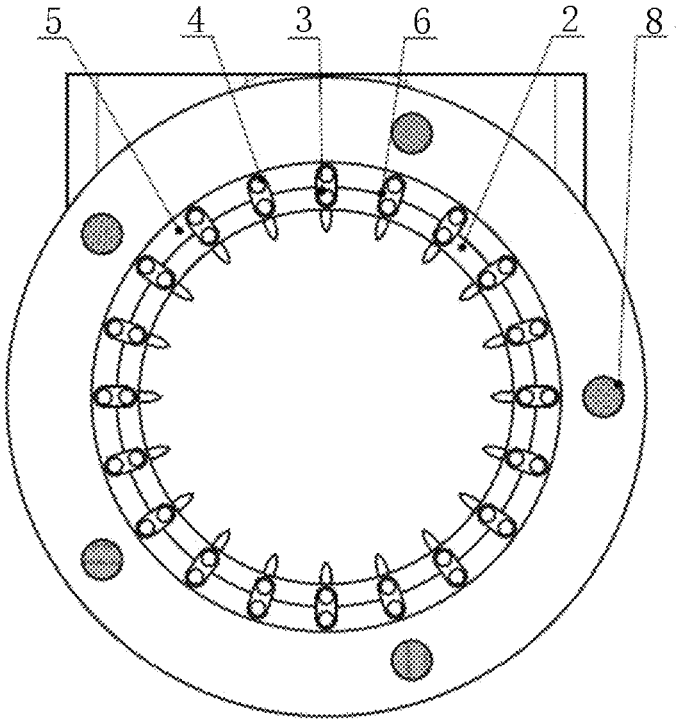
FIG. 4 is a structural schematic diagram of the hybrid gas intake device shown in FIG. 3 along an A-A direction.
Figure 5:
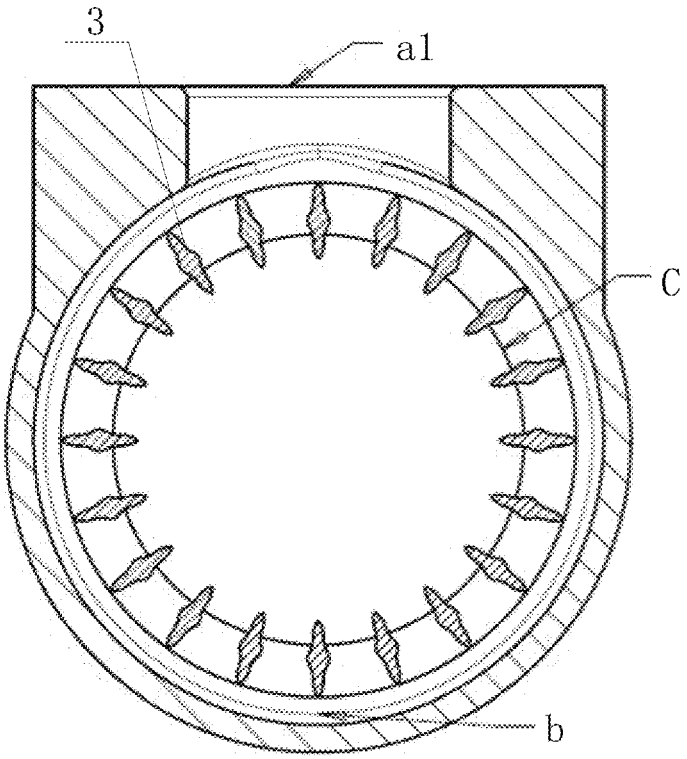
FIG. 5 is a structural schematic diagram of the hybrid gas intake device shown in FIG. 3 along a B-B direction.
Figure 6:
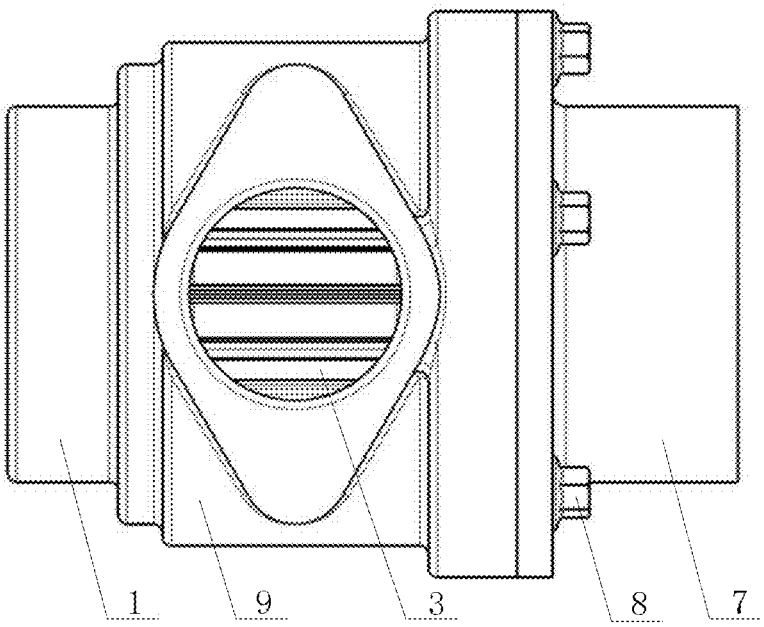
FIG. 6 is a top view of the hybrid gas intake device in a case that blades are closed according to an embodiment of the present disclosure.

A core of the present disclosure is to provide a hybrid gas intake device of an engine, which has a small volume. Another object of the present disclosure is to provide an engine including the hybrid gas intake device.

In order to enable those skilled in the art to better understand technical solutions of the present disclosure, the technical solutions of the present disclosure are further described in detail below with reference to the drawings and embodiments.

Reference is made to FIG. 1 to FIG. 12. In an embodiment, a hybrid gas intake device of an engine according to an embodiment of the present disclosure includes a gas intake pipe, a blade 3 arranged in the gas intake pipe, and a flow control device configured to adjust an interval between two adjacent blades 3. A side wall of the gas intake pipe is provided with an exhaust gas inlet. The blade 3 is arranged at an end of the exhaust gas inlet, a number of the blade 3 is more than one, and the more than one blade 3 is distributed along a ring. Exhaust gas intake space is formed between the blade 3 and the side wall of the gas intake pipe. As temperature of the exhaust gas is usually high, the blade 3 is preferably a metal blade to prolong a service life of the hybrid gas intake device. In an embodiment, the blade 3 may be made of steel.

In practical operation of the engine, the interval between two adjacent blades 3 is adjusted by the flow control device, to control the intake flow of the exhaust gas. The exhaust gas flows into the gas intake pipe through the interval between two adjacent blades 3 and is mixed with the air. Finally, the mixed gas flows into the engine body through the gas intake pipe.

In an embodiment, a gas flow direction during operation is described as follows. The exhaust gas flows into a gas passage of the gas intake pipe sequentially through an inlet al of a mixing pipe, a region b between an outer contour of the blades 3 and the gas intake pipe, and a region c between adjacent blades 3. In this case, fresh air flows into the gas passage of the gas intake pipe through an inlet a2 of the gas intake pip. The exhaust gas is mixed with the fresh air during flowing, and then the mixed gas is discharged through a gas outlet d of the gas intake pipe.

It can be seen from the above description that in the hybrid gas intake device according to the embodiment of the present disclosure, the interval between two adjacent blades 3 is adjusted by the flow control device so as to adjust the intake flow of the exhaust air, thereby eliminating the need to install a dedicated valve. Since the multiple blades 3 are distributed along a ring, the exhaust gas and the air can be well-mixed after the exhaust gas flows into the gas intake pipe, thereby eliminating the need to install a dedicated mixer. That is, an area of a cross section through which the exhaust gas flows into the gas passage is changed, so as to control an EGR flow. The exhaust gas flows into the gas passage through the interval between adjacent blades 3, to form annular air inflow, so that the EGR exhaust gas and the fresh air can be well-mixed. In this way, a function of controlling the EGR flow and a function of controlling the air and the exhaust gas to be well-mixed can be achieved by one module, thereby effectively reducing the overall volume of the hybrid gas intake device.

Preferably, the more than one blade 3 is arranged along a circle, a centerline of the circle coincides with an axis of the gas intake pipe, and an interval between each two adjacent blades 3 is the same.

Preferably, the flow control device includes a connection element 6, a fixed plate 2, a rotatable plate 5, and a driving device configured to drive the rotatable plate 5 to rotate. In an embodiment, the driving device may be a rotary cylinder, a motor or the like. In an embodiment, the motor may drive the rotatable plate 5 to rotate through a gear assembly. Preferably, the motor is a stepping motor. The fixed plate 2 is fixed relative to the gas intake pipe. The blade 3 is connected to the fixed plate 2 by a first hinge pin. The first hinge pin is in clearance fit with the fixed plate 2. The rotatable plate 5 is fixedly connected to a second hinge pin 4 in one-to-one correspondence with the first hinge pin. The second hinge pin 4 is rotatably connected to the connection element 6. The connection element 6 is fixedly connected to the first hinge pin. The first hinge pin is in one-to-one correspondence with the blade 3.

In order to improve stability, preferably, the flow control device includes two fixed plates 2 and two rotatable plates 5. The rotatable plates 5 are in one-to-one correspondence with the fixed plates 2. The two fixed plates 2 are arranged at two opposite ends of the blade 3 respectively. In an embodiment, each rotatable plate 5 corresponds to a respective connection element 6.

In another embodiment, the flow control device includes a fixed plate 2, a rotatable plate 5, and a driving device configured to drive the rotatable plate 5 to rotate. In an embodiment, the driving device may be a rotary cylinder a motor or the like. The blade 3 is provided with a first rotatable shaft rotatably connected to the fixed plate 2 and a second rotatable shaft connected to the rotatable plate 5. The rotatable plate 5 is provided with a groove for the second rotatable shaft to slide along.

Figure 7:
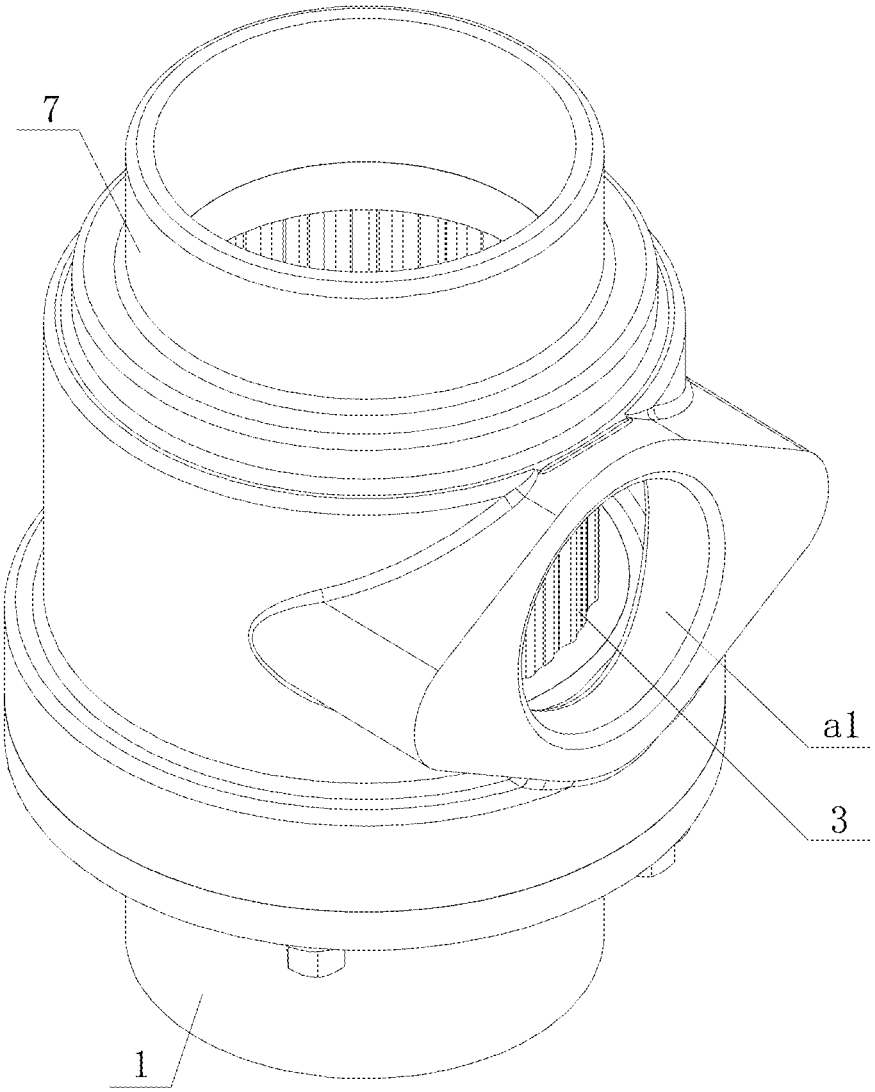
FIG. 7 is a three-dimensional structural diagram of the hybrid gas intake device in the case that blades are closed according to an embodiment of the present disclosure.
Figure 8:
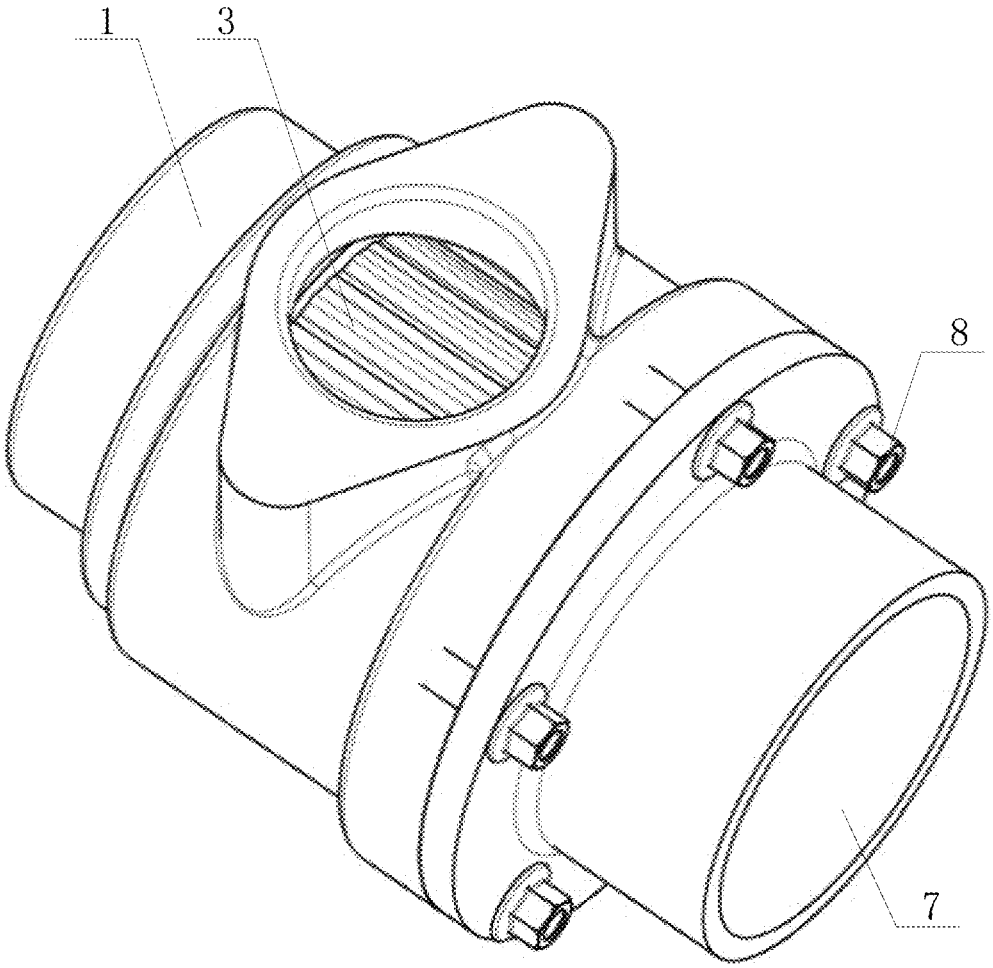
FIG. 8 is a three-dimensional structural diagram of the hybrid gas intake device from another perspective in the case that blades are closed according to an embodiment of the present disclosure.
Figure 9:
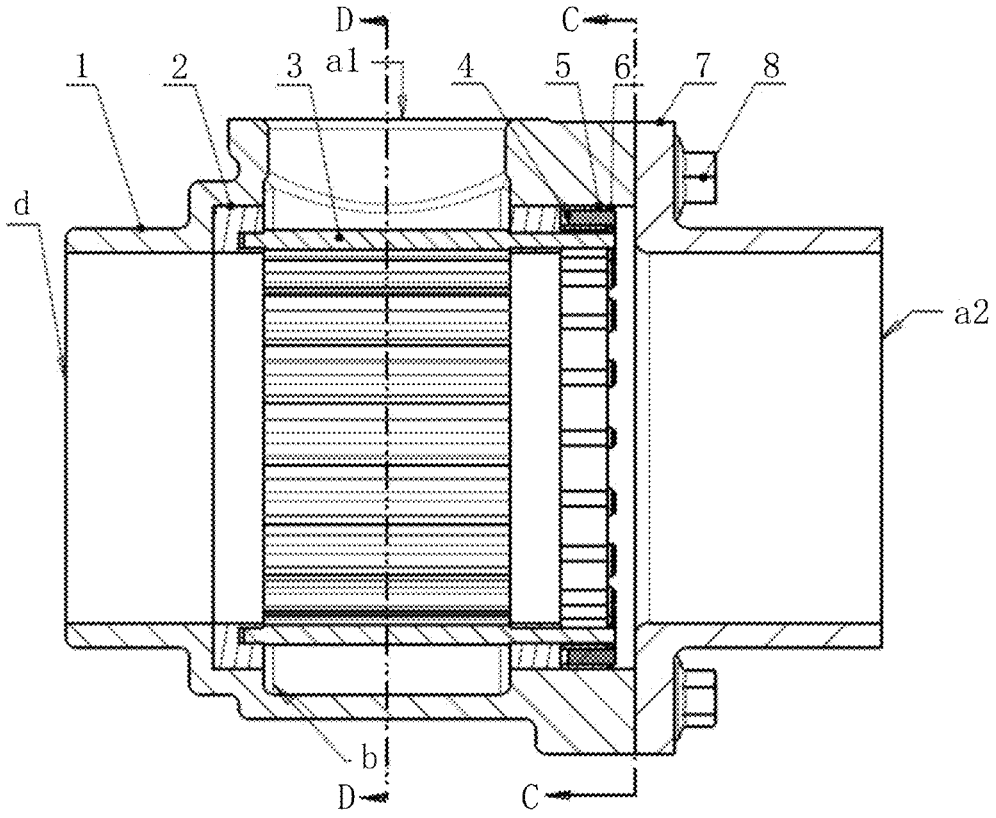
FIG. 9 is a schematic structural diagram of the hybrid gas intake device in the case that blades are closed according to an embodiment of the present disclosure.
Figure 10:
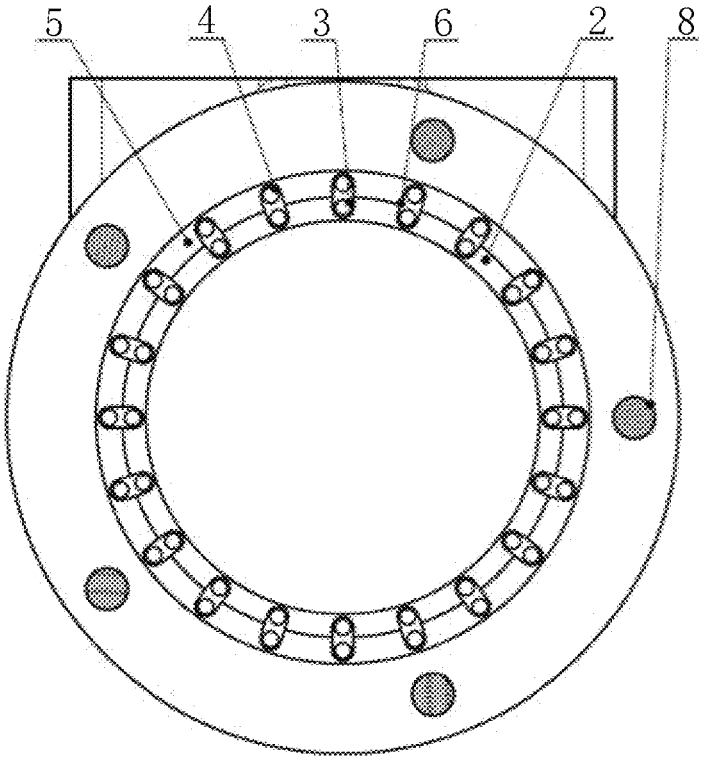
FIG. 10 is a schematic structural diagram of the hybrid gas intake device shown in FIG. 9 along a C-C direction.
Figure 11:
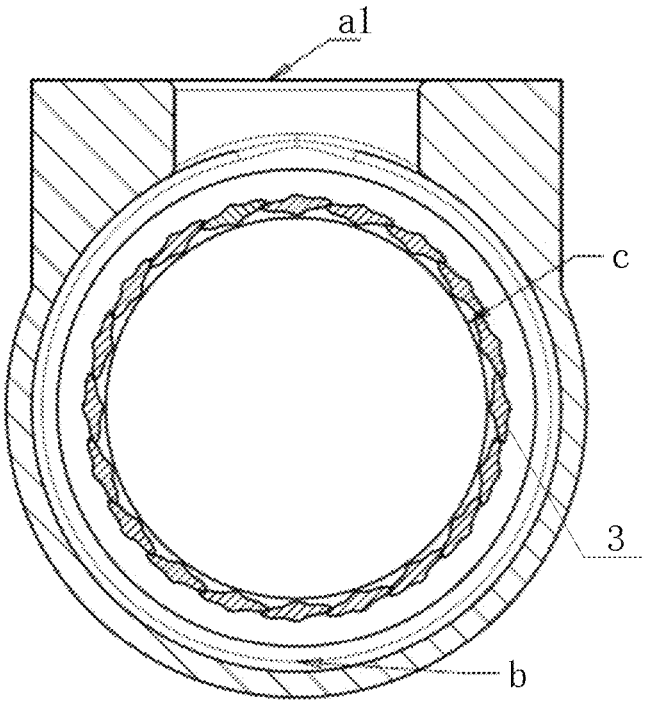
FIG. 11 is a schematic structural diagram of the hybrid gas intake device shown in FIG. 9 along a D-D direction.
Figure 12:
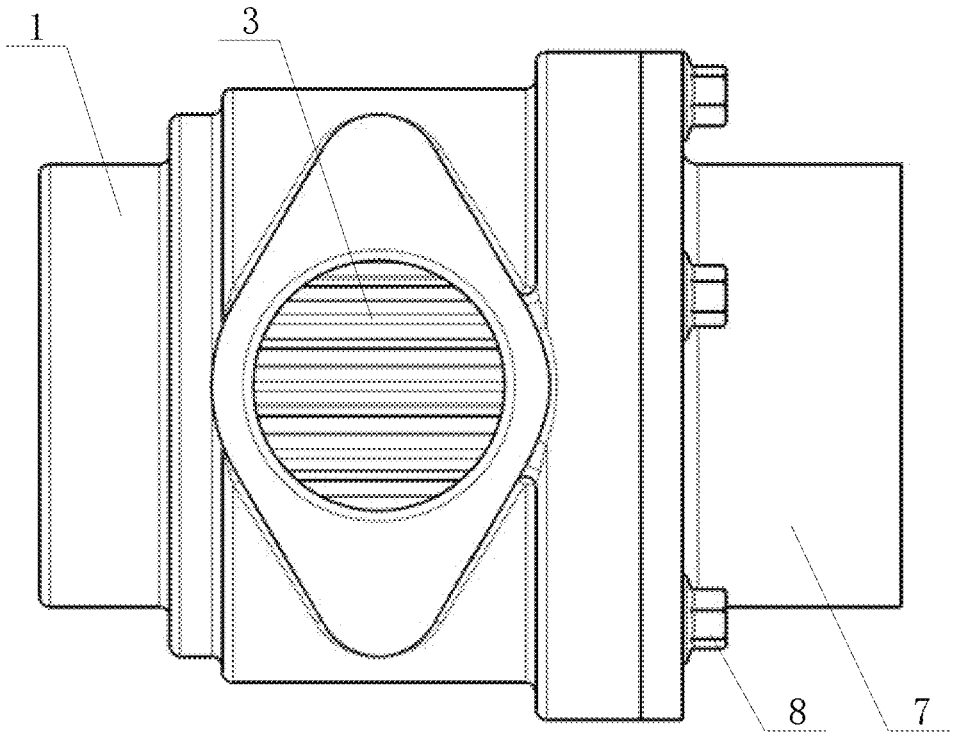
FIG. 12 is a top view of the hybrid gas intake device in the case that blades are closed according to an embodiment of the present disclosure.

The exhaust gas flows into the gas passage through the region c between the blades 3 and is mixed with the fresh gas. After angles of the blades 3 are changed, a cross section formed by the blades for gas intake is changed, so as to control the EGR flow. As shown in FIG. 1, the blades 3 are fully opened, and an area of the region C between the blades 3 is large, thus the EGR flow has a large value. As shown in FIG. 7, the area of the region C between the blades 3 is small, thus the EGR flow has a small value. The EGR flow may has a minimum value of zero.

In an embodiment, the gas intake pipe includes an air intake section 7, a blade mounting section 9, and a gas outlet section 1 that are sequentially arranged along a gas moving direction. The blade 3 and the flow control device are located in the blade mounting section 9. In an embodiment, the air intake section 7, the blade 3 mounting section, and the gas outlet section 1 are detachably connected sequentially.

In order to reduce obstruction to gas flow, preferably, an inner diameter of the fixed plate 2 is equal to an inner diameter of the air intake section 7, and the inner diameter of the air intake section 7 is equal to an inner diameter of the gas outlet section 1. The rotatable plate 5 is sleeved outside the fixed plate 2. An outer wall of the rotatable plate 5 is in clearance fit with a side wall of the blade mounting section 9. That is, the gas intake pipe has a smooth inner wall.

In order to facilitate assembly and disassembly of the hybrid gas intake device, preferably, the blade mounting section 9 is integrally formed with the gas outlet section 1, and the blade mounting section 9 is detachably connected to the air intake section 7. In an embodiment, the blade mounting section 9 is provided with a first flange end, and the air intake section 7 is provided with a second flange end. The first flange end is connected to the second flange end by a threaded fastener 8. Preferably, multiple threaded fasteners 8 are uniformly distributed along a circumferential direction of the blade mounting section 9. Since the blade mounting section 9 is detachably connected to the air intake section 7, it is convenient to clean the blade 3 subsequently.

In order to prolong a service life of the blade 3, preferably, the blade 3 has a fusiform cross section in a direction perpendicular to an axis of the gas intake pipe. That is, the blade 3 is thick in the middle and thin at two ends.

In order to facilitate manufacture of the blade 3 and improve manufacturing efficiency, preferably, the blade 3 is integrally formed.

Based on the above technical solutions, in order to prolong the service life of the hybrid gas intake device, preferably, an anticorrosive layer is provided on a surface of the blade 3.

An engine is provided according to the present disclosure. The engine includes an engine body and a hybrid gas intake device connected to a gas inlet of the engine body, where the hybrid gas intake device of the engine is the hybrid gas intake device according to any of the above embodiments.

Embodiments in this specification are described in a progressive way, each of which emphasizes the differences from others, and reference can be made to each other of the embodiments for the same or similar parts among the embodiments.

Based on the above description of the disclosed embodiments, those skilled in the art can implement or carry out the present disclosure. It is obvious for those skilled in the art to make many modifications to these embodiments. The general principle defined herein may be applied to other embodiments without departing from the spirit or scope of the present disclosure. Therefore, the present disclosure is not limited to the embodiments illustrated herein, but should be defined by the widest scope consistent with the principle and novel features disclosed herein.

The invention claimed is:

1. A hybrid gas intake device of an engine, comprising:

a gas intake pipe, wherein a side wall of the gas intake pipe is provided with an exhaust gas inlet;

a plurality of blades arranged in the gas intake pipe; and a flow control device configured to adjust an interval between each two adjacent blades of the plurality of blades, wherein the plurality of blades are arranged in a segment of the gas intake pipe where the exhaust gas inlet is located, the plurality of blades are distributed along a ring, and exhaust gas intake space is formed between the plurality of blades and the side wall of the gas intake pipe.

2. The hybrid gas intake device according to claim 1, wherein plurality of blades are distributed along a circle, a centerline of the circle coincides with an axis of the gas intake pipe, and the interval between each two adjacent blades of the plurality of blades is the same.

3. The hybrid gas intake device according to claim 1, wherein the flow control device comprises:

a connection element;

a fixed plate;

a rotatable plate; and a driving device configured to drive the rotatable plate to rotate, wherein:

the fixed plate is fixed relative to the gas intake pipe;

each of the plurality of blades is connected to the fixed plate by a first hinge pin, and the first hinge pin is in clearance fit with the fixed plate;

the rotatable plate is fixedly connected to a second hinge pin that is in one-to-one correspondence with the first hinge pin, and the second hinge pin is rotatably connected to the connection element; and the connection element is fixedly connected to the first hinge pin, and the first hinge pin is in one-to-one correspondence with the blade.

4. The hybrid gas intake device according to claim 1, wherein the flow control device comprises two fixed plates and two rotatable plates, the rotatable plates are in one-to-one correspondence with the fixed plates, and the two fixed plates are arranged at two opposite ends of the plurality of blades respectively.

5. The hybrid gas intake device according to claim 4, wherein the gas intake pipe comprises an air intake section, a blade mounting section, and a gas outlet section that are sequentially arranged along a gas moving direction, and wherein the plurality of blades and the flow control device are located in the blade mounting section, an inner diameter of each of the fixed plates is equal to an inner diameter of the air intake section, the inner diameter of the air intake section is equal to an inner diameter of the gas outlet section, each of the rotatable plates is sleeved outside the corresponding fixed plate, and an outer wall of the rotatable plate is in clearance fit with a side wall of the blade mounting section.

6. The hybrid gas intake device according to claim 5, wherein the blade mounting section is integrally formed with the gas outlet section, and the blade mounting section is detachably connected to the air intake section.

7. The hybrid gas intake device according to claim 1, wherein each of the plurality of blades has a fusiform cross section in a direction perpendicular to an axis of the gas intake pipe.

8. The hybrid gas intake device according to claim 7, wherein the blade is integrally formed.

9. The hybrid gas intake device according to claim 1, wherein an anticorrosive layer is provided on a surface of each of the plurality of blades.

10. An engine, comprising:

an engine body; and a hybrid gas intake device connected to a gas inlet of the engine body, wherein the hybrid gas intake device of the engine comprises:

a gas intake pipe, wherein a side wall of the gas intake pipe is provided with an exhaust gas inlet;

a plurality of blades arranged in the gas intake pipe; and a flow control device configured to adjust an interval between each two adjacent blades of the plurality of blades, wherein the plurality of blades are arranged in a segment of the gas intake pipe where the exhaust gas inlet is located, the plurality of blades are distributed along a ring, and exhaust gas intake space is formed between the plurality of blades and the side wall of the gas intake pipe.

11. The hybrid gas intake device according to claim 2, wherein an anticorrosive layer is provided on a surface of each of the plurality of blades.

12. The hybrid gas intake device according to claim 3, wherein an anticorrosive layer is provided on a surface of each of the plurality of blades.

13. The engine according to claim 10, wherein the plurality of blades are distributed along a circle, a centerline of the circle coincides with an axis of the gas intake pipe, and the interval between each two adjacent blades of the plurality of blades is the same.

14. The engine according to claim 10, wherein the flow control device comprises:

a connection element;

a fixed plate;

a rotatable plate; and a driving device configured to drive the rotatable plate to rotate, wherein:

the fixed plate is fixed relative to the gas intake pipe;

each of the plurality of blades is connected to the fixed plate by a first hinge pin, and the first hinge pin is in clearance fit with the fixed plate;

the rotatable plate is fixedly connected to a second hinge pin that is in one-to-one correspondence with the first hinge pin, and the second hinge pin is rotatably connected to the connection element; and the connection element is fixedly connected to the first hinge pin, and the first hinge pin is in one-to-one correspondence with the blade.

15. The engine according to claim 10, wherein the flow control device comprises two fixed plates and two rotatable plates, the rotatable plates are in one-to-one correspondence with the fixed plates, and the two fixed plates are arranged at two opposite ends of the plurality of blades respectively.

16. The engine according to claim 15, wherein the gas intake pipe comprises an air intake section, a blade mounting section, and a gas outlet section that are sequentially arranged along a gas moving direction, and wherein the plurality of blades and the flow control device are located in the blade mounting section, an inner diameter of each of the fixed plates is equal to an inner diameter of the air intake section, the inner diameter of the air intake section is equal to an inner diameter of the gas outlet section, each of the rotatable plates is sleeved outside the corresponding fixed plate, and an outer wall of the rotatable plate is in clearance fit with a side wall of the blade mounting section.

17. The engine according to claim 16, wherein the blade mounting section is integrally formed with the gas outlet section, and the blade mounting section is detachably connected to the air intake section.

18. The engine according to claim 10, wherein each of the plurality of blades has a fusiform cross section in a direction perpendicular to an axis of the gas intake pipe.

19. The engine according to claim 18, wherein the blade is integrally formed.

20. The engine according to claim 10, wherein an anticorrosive layer is provided on a surface of each of the plurality of blades.

* * * * *